US007892613B2

(12) United States Patent
Meazle et al.

(10) Patent No.: US 7,892,613 B2
(45) Date of Patent: Feb. 22, 2011

(54) REDUCING TOP PLY BASIS WEIGHT OF WHITE TOP LINERBOARD IN PAPER OR PAPERBOARD

(75) Inventors: John Meazle, Shreveport, LA (US); Peter Froass, Mason, OH (US)

(73) Assignee: International Paper Company, Memphis, TN (US)

( * ) Notice: Subject to any disclaimer, the term of this patent is extended or adjusted under 35 U.S.C. 154(b) by 35 days.

(21) Appl. No.: 11/711,338

(22) Filed: Feb. 27, 2007

(65) Prior Publication Data

US 2007/0202347 A1 Aug. 30, 2007

Related U.S. Application Data

(63) Continuation-in-part of application No. 11/363,220, filed on Feb. 27, 2006.

(51) Int. Cl.
*B32B 27/10* (2006.01)
*B32B 27/12* (2006.01)

(52) U.S. Cl. ..... 428/34.2; 428/34.1; 428/35.7; 428/35.9; 428/36.9; 428/36.91

(58) Field of Classification Search ..... 428/34.1, 428/34.2, 35.7, 35.9, 36.9, 36.91
See application file for complete search history.

(56) References Cited

U.S. PATENT DOCUMENTS 3,151,019 A 9/1964 Shildneck et al.
3,293,114 A 12/1966 Kenaga et al.
3,533,908 A 10/1970 Hoogsteen
3,556,934 A 1/1971 Meyer
4,133,688 A 1/1979 Sack
4,483,889 A 11/1984 Andersson
4,985,490 A * 1/1991 Rosthauser et al. ..... 524/871
5,125,996 A 6/1992 Campbell et al.
5,496,440 A 3/1996 Carre et al.

(Continued)

FOREIGN PATENT DOCUMENTS

EP 1249534 A 10/2002

(Continued)

OTHER PUBLICATIONS

Handbook for Pulp & Paper Technologies, 2nd Edition, G.A. Smook, Angus Wilde Publications (1992).

*Primary Examiner*—Marc A Patterson
(74) *Attorney, Agent, or Firm*—Matthew M. Eslami

(57) ABSTRACT

The present invention relates to multi-ply paper and paperboard products in which individual plies are formed of lingocellulosic fibers having different GE brightnesses. The paper or paperboard substrate having top and bottom surfaces comprises a base ply having top and bottom surfaces and comprising ligno cellulosic fibers having a first brightness x. A top ply having top and bottom surfaces comprising ligno cellulosic fibers having a second brightness y which is greater than the first brightness x. The top surface of the top ply forms the top surface of the substrate. An intermediate layer having top and bottom surfaces positioned between the top and base plies. The intermediate layer comprises an organic and inorganic material. The intermediate layer is configured such that the paper or paperboard has a top surface third brightness z which is greater that the first brightness x and is equal to or less than the second brightness y.

24 Claims, 7 Drawing Sheets

U.S. PATENT DOCUMENTS

| | | | | |
|---|---|---|---|---|
| 5,514,429 | A | 5/1996 | Kamihgaraguchi et al. | |
| 5,792,317 | A | 8/1998 | Taylor et al. | |
| 5,985,030 | A | 11/1999 | Taylor et al. | |
| 5,997,692 | A | 12/1999 | Taylor et al. | |
| 6,207,242 | B1 * | 3/2001 | Hoffman | 428/34.2 |
| 6,802,938 | B2 | 10/2004 | Mohan et al. | |
| 6,886,906 | B2 | 5/2005 | Marvyama et al. | |

FOREIGN PATENT DOCUMENTS

| | | | |
|---|---|---|---|
| EP | 0963487 | A1 | 10/2004 |
| GB | 2307487 | | 5/1997 |
| WO | WO9729238 | A1 | 8/1997 |
| WO | WO9932721 | A1 | 7/1999 |

* cited by examiner

REDUCING TOP PLY BASIS WEIGHT OF WHITE TOP LINERBOARD IN PAPER OR PAPERBOARD

This is a continuation-in part of application Ser. No. 11/363,220 filed on Feb. 27, 2006.

FIELD OF THE INVENTION

The present invention relates to paper and paperboard products. More particularly to the invention relates to multi-ply paper and paperboard products in which individual plies are formed of ligno cellulosic fibers having different GE brightnesses.

BACKGROUND OF THE INVENTION

Paper products are well known in everyday life. Paper products may comprise a single ply, but frequently comprise two or more plies. As used herein, a "ply" refers to a single sheet taken off a forming wire of a paper or a paperboard machine, or the equivalent thereof.

SUMMARY OF THE INVENTION

Accordingly, one aspect of the present invention is directed to a paper or paperboard substrate that comprises a base ply comprising ligno cellulosic fibers having a first brightness x. The substrate also comprises a top ply comprising ligno cellulosic fibers having a second brightness y which is greater than the first brightness x and an intermediate layer positioned between the top and bottom plies, preferably bonded to the top surface of the bottom ply and the bottom surface of the top ply, that comprises a polymeric binder such as starch and a pigment. The intermediate layer is configured such that the paper or paperboard substrate has a surface third brightness z wherein the third brightness z is greater that the first brightness x and is equal to or less than the second brightness y.

Another aspect of the present invention relates to a method of making a multi-ply paper or paperboard while reducing weight basis of a top ply. The method comprises the steps of applying a mixture comprising starch and a filler to a surface of a base ply to form an intermediate layer. The base ply includes a preselected color. Next, applying the top ply is applied to the surface of the intermediate layer wherein the intermediate layer is configured to obscure the color of the base ply when viewed through the top ply.

A further aspect of the present invention relates to articles of manufacture such as corrugated cardboard and any product made with corrugated cardboard like corrugated containers and displays formed from the paper or paperboard substrate of this invention.

Opacity and brightness are important reflectance values of paper. Opacity characterizes the ability of paper to hide text or pictures on the back side of the sheet. Brightness is the reflectance of paper using blue light. Blue light is used because papermaking fibers have a yellowish color and because the human eyes perceive blue color as brightness.

DETAILED DESCRIPTION OF THE INVENTION

As used throughout, ranges are used as a short hand for describing each and every value that is within the range. Any value within the range can be selected as the terminus of the range. Also as used herein the term paper is used as short hand to describe paper, paperboard or paper and paperboard.

Figure 1:
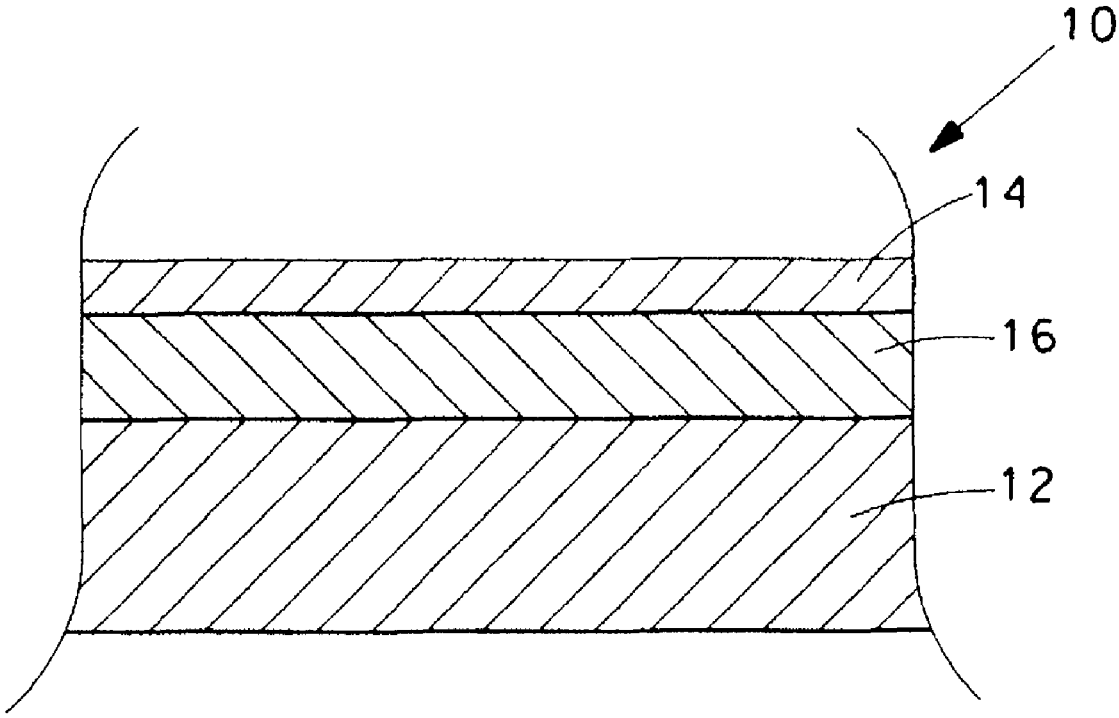
FIG. 1 is a cross sectional view of a multi-ply paper or paperboard in accordance with the present invention.

As depicted in FIG. 1, one aspect of the invention relates to a multi-ply paper or paperboard 10. The paper or paperboard 10 comprises a base ply 12 comprising lingo cellulosic fiber having a first brightness x and a top ply 14 comprising ligno cellulosic fibers having a second brightness y wherein the first brightness x is less than the second brightness y. An intermediate layer 16 comprising a binder and a pigment is positioned between top ply 14 and base ply 12.

As depicted in the preferred embodiment of FIG. 1, the intermediate layer 16 is bonded to the top surface of base ply 12 and to the bottom surface of top ply 14. However, in the broadest aspects of this invention any number of layers comprising binders and pigments or ligno cellulosic fibers can be positioned between plies 12 and 14 and intermediate layer 16

The total basis weight of the multi-ply paper 10 may vary widely depending upon the intended function of the multi-ply paper 10 and any basis weight can be used. In one example, the total basis weight of the multi-ply paper 10 may range from as low as about 5 lb per 1000 $ft^2$ or lower to about 300 lb per 1000 $ft^2$ or higher. In another example, the total basis weight of the multi-ply paper 10 may range from about 20 lb per 1000 $ft^2$ to about 150 lb per 1000 $ft^2$. As a further example, the total basis weight of the multi-ply paper 10 may range from about 26 lb per 1000 $ft^2$ to about 69 lb per 1000 $ft^2$.

The caliper of the multi-ply paper or paperboard 10 may also vary widely depending on the application that the multi-ply paper is used and any caliper can be used. As an example, the caliper of the multi-ply paper 10 may have a range from about 3 mils or lower to about 49 mils or higher. As another example, the caliper of the multi-ply paper 10 may have a range from about 7 mils to 33 mils. As a further example, the caliper of the multi-ply paper 10 may have a range from about 9 mils to 23 mils.

The relative basis weights of intermediate layer 16, top ply 14 and base ply 12 may vary widely depending on the desired amount of top ply 14, base ply 12 and intermediate layer 16 and the desired values for brightenesses x, y and z. Preferably, the basis weight of top ply 14 is less than the basis weight of base ply 12.

The pulp forming base ply 12 has a brightness x and the pulp forming top ply 14 has a brightness y and since y is greater than x, then quantity (y>x) would reduce the surface brightness z of paper or paperboard 10, due to the potential show through of the lower brightness pulp. However, higher brightness intermediate layer 16 formed from white or substantially white binder and pigment provides an opacifying effect that reduces or prevents the show through of the lower brightness pulp forming base ply 12 thereby reducing the difference between brightness y and surface brightness z and increasing the difference between surface brightness z and brightness x. In general where the basis weights of plies 12 and 14 are constant, the greater the basis weight of intermediate layer 16 the lesser the difference between brightness y and surface brightness z and the greater the difference between surface brightness z and brightness x. However, the smaller the basis weight of intermediate layer 16, the greater the difference between brightness y and surface brightness z and the smaller the difference between surface brightness z and brightness x.

Preferably, the amount of intermediate layer 16 can range from about 0.5 to about 20% by weight of intermediate layer 16, base ply 12 and top ply 14, and the amount of base ply 12 can range from about 40 to about 80% by weight of intermediate layer 16, base ply 12 and top ply 14; and the amount of top ply 14 can range from about 20 to about 60% by weight of intermediate layer 16, base ply 12 and top ply 14. More preferably, the amount of intermediate layer 16 can range from about 1 to about 15% by weight of intermediate layer 16, base ply 12 and top ply 14; and the amount of base ply 12 can range from about 50 to about 75% by weight of intermediate layer 16, base ply 12 and top ply 14; and the amount of top ply 14 can range from about 25 to about 50% by weight of intermediate layer 16, base ply 12 and top ply 14. Most preferably, the amount of intermediate layer 16 can range from about 2 to about 10% by weight of intermediate layer 16, base ply 12 and top ply 14; and the amount of base ply 12 can range from about 60 to about 75% by weight of intermediate layer 16, base ply 12 and top ply 14; and the amount of top ply 14 can range from about 25 to about 40% by weight of intermediate layer 16, base ply 12 and top ply 14.

The weight ratio of the amount of base ply 12 to the amount of top ply 14 to the amount of intermediate layer 16 the may vary widely depending on the desired amount of top ply 14, base ply 14 and intermediate layer 16 and the desired values for brightenesses x, y and z. For example, the weight ratio of the basis weight of base ply 12 to the basis weight of top ply 14 can be from about 10:90 to about 97:3. In the preferred embodiments of the invention, the weight ratio of the basis weight of base ply 12 to the basis weight of top ply 14 can be from about 20:80 to about 95:5. In the more preferred embodiments of the invention, the weight ratio of the basis weight of base ply 12 to the basis weight of top ply 14 can be from about 50:50 to about 90:10. In the most preferred embodiments of the invention, the weight ratio of the basis weight of base ply 12 to the basis weight of top ply 14 can be from about 60:40 to about 80:20.

Multi-ply paper or paperboard 10 has a surface brightness z. Surface brightness z is the GE brightness and is determined in accordance with the procedure of TAPPI Method T452. This method is used to determine the brightness of white, near white and naturally colored pulp, paper and paperboard. In general, surface brightness z can vary widely depending on the uses made of the multi-ply paper or paper board. Usually surface brightness z is at least about 70. Surface brightness z is preferably from about 70 to about 100, more preferably from about 75 to about 100 and most preferably from about 80 to about 95.

Usually, surface brightness z is equal to or less than brightness y and is greater that brightness x. The surface brightness z in any situation will depend in part on the opacifying effect of intermediate layer 16 and top ply 14 to reduce or prevent show through of the lower brightness base ply 12 when the multi-ply paper or paperboard is viewed top down on the top surface of top ply 14. While we do not wish to be bounded by any theory, it is believed that the opacifying effect will depend on such factors as thickness and brightness of intermediate layer 16 and top ply 14. Usually, surface brightness z is not more that 20 brightness units less that brightness y of the ligno cellulosic fibers forming top ply 14. In the preferred embodiments of the invention, surface brightness z is not more that 20 brightness units less that brightness y of the ligno cellulosic fibers forming top ply 14. In the more preferred embodiments of the invention, surface brightness z is not more that 10 brightness units less that brightness y of the ligno cellulosic fibers forming top ply 14. In the most preferred embodiments of the invention, surface brightness z is not more that 5 brightness units less that brightness y of the ligno cellulosic fibers forming top ply 14.

Base ply 12 and top ply 14 are composed of ligno cellulosic fibers. The type of fiber is not critical and any such fiber known for use in paper making can be used. For example, the substrate can be made from pulp fibers derived from hardwood trees, softwood trees, or a combination of hardwood and softwood trees prepared for use in a papermaking furnish by any known suitable digestion, refining, and bleaching operations as for example known mechanical, thermomechanical, chemical and semichemical, etc., pulping and other well known pulping processes. For example, the lingo cellulosic fibers can be produced by a typical Kraft process, in which wood chips are cooked at a temperature of approximately 180° C. with the addition of sodium hydroxide and sodium hydrosulfide (conventional Kraft white liquor) for a period of about 20 to 60 minutes to dissolve the lignin and hemi-cellulose. After cooking, the pulp is washed, which acts to remove up to 98% of the treating chemicals. The pulp is then diluted with water to a solids content of about 4% and treated with sulfuric acid and alum to obtain a pH generally in the range of about 4.0 to 8.0. The term "hardwood pulps" as used herein refers to fibrous pulp derived from the woody substance of deciduous trees (angiosperms) such as birch, oak, beech, maple, and eucalyptus, whereas "softwood pulps" are fibrous pulps derived from the woody substance of coniferous trees (gymnosperms) such as varieties of fir, spruce, and pine, as for example loblolly pine, slash pine, Colorado spruce, balsam fir and Douglas fir. In certain embodiments, at least a portion of the pulp fibers may be provided from non-woody herbaceous plants including, but not limited to, kenaf, hemp, jute, flax, sisal, or abaca although legal restrictions and other considerations may make the utilization of hemp and other fiber sources impractical or impossible. Either bleached or unbleached pulp fiber may be utilized in the process of this invention. Recycled pulp fibers are also suitable for use. In a preferred embodiment, the cellulosic fibers in the paper include from about 30% to about 100% by weight dry basis softwood fibers and from about 70% to about 0% by weight dry basis hardwood fibers.

In addition to the ligno cellulosic fibers, bottom ply 12 and top ply 14 may also include other conventional additives such as, for example, fillers, retention aids, wet strength resins and dry strength resins that may be incorporated into ligno cellulosic fiber based substrates. Among the fillers that may be used are inorganic and organic pigments such as, by way of example, minerals such as calcium carbonate, barium sulfate, titanium dioxide, calcium silicates, mica, kaolin and talc, and polymeric particles such as polystyrene latexes and polymethylmethacrylate. Other conventional additives include, but are not restricted to, alum, fillers, pigments and dyes. The paper substrate may also include dispersed within the lingo cellulose fibers from expanded or unexpanded microspheres. Expanded and expandable microspheres are well known in the art. For example, suitable expandable microspheres are described in U.S. Pat. Nos. 3,556,934; 5,514,429; 5,125,996;

3,533,908; 3,293,114; 4,483,889; 4,133,688; 6,802,938; 6,886,906; and UK Patent Application 2,307,487; the contents of which are incorporated by reference. All conventional microspheres can be used in the practice of this invention. Suitable microspheres include synthetic resinous particles having a generally spherical liquid-containing center. The resinous particles may be made from methyl methacrylate, ortho-chlorostyrene, polyortho-chlorostyrene, polyvinylbenzyl chloride, acrylonitrile, vinylidene chloride, para-tert-butyl styrene, vinyl acetate, butyl acrylate, styrene, methacrylic acid, vinylbenzyl chloride and combinations of two or more of the foregoing. Preferred resinous particles comprise a polymer containing from about 65 to about 90 percent by weight vinylidene chloride, preferably from about 65 to about 75 percent by weight vinylidene chloride, and from about 35 to about 10 percent by weight acrylonitrile, preferably from about 25 to about 35 percent by weight acrylonitrile. Suitable expandable microspheres are available from Akzo Nobel of Marietta, Ga. under the trade name EXPANCEL. Expandable microspheres and their usage in paper materials are described in more detail in U.S. Pat. Nos. 6,802,938, and 6,886,906; the contents of which are incorporated by reference.

Ligno cellulosic fibers used form base ply 12 have a brightness x and ligno cellulosic fibers used to form top ply 14 have a brightness y, where brightness y is greater than brightness x, and brightness x is less than brightness z. The GE brightness of ligno cellulosic fibers forming top ply 14 and base ply 12 is determined in accordance with the procedure of TAPPI method T452. The brightness values can be determined by testing the ligno cellulosic fibers prior to formation of the ply or the multi ply paper or paperboard. Alternatively, the ligno cellulosic fibers can be isolated from the fabricated multi-ply paper or paperboard and the brightness values of the isolated fibers can be determined by testing. One useful isolation method is as follows. The top ply of the multiply paperboard can be split from the base ply using a knife or razor blade. Carefully doing so can result in a sheet that is not contaminated with the base ply and easily measured for brightness. In general brightnesses x and y can vary widely depending on the uses made of the multi-ply paper or paper board. Usually brightness x is less than about 70, preferably from about 5 to about 70, more preferably from about 10 to about 50 and most preferably from about 10 to about 30. Usually brightness y is at least about 70, preferably from about 70 to about 100, more preferably from about 75 to about 97 and most preferably from about 80 to about 95.

Brightness y is greater than brightness x. Usually, the difference in brightness can be as low as about 1 to as high as about 95 brightness units, and is preferably from about 10 to about 90 brightness units, more preferably from about 20 to about 85 brightness units and most preferably from about 30 to about 80 brightness units.

The basis weights of base ply 12 and top ply 14 are the same or different and may vary widely and any basis weight can be used. For example, the basis weights of base ply 12 and top ply 14 can range from about 6 lb per 1000 $ft^2$ to about 300 lb per 1000 $ft^2$. For example, the basis weight of the base ply 12 may have a range from about 13 lb per 1000 $ft^2$ to about 64 lb per 1000 $ft^2$. As a further example, the basis weight of the base ply 12 may have a range from about 17 lb per 1000 $ft^2$ to about 44 lb per 1000 $ft^2$.

The calipers of base ply 12 and top ply 14 may vary widely and any conventional calipers may be employed. In one example of the invention, calipers may have a range from about 2 mils to about 31 mils. In another example, the caliper of the base ply 12 may also have a range from about 4 mils to about 21 mils. In a further example, the caliper of the base ply 12 may have a range from about 5 mils to about 14 mils.

In some cases, the top ply 14 of the multi-ply paperboard can be coated with a pigmented or non-pigmented formulation to improve appearance. While useful pigments may vary widely, illustrative of useful pigments are ground calcium carbonate or alternatively, clay or calcium sulfate. This product is primarily used as a liner with high visual appeal in corrugated containers. High compressive strength and good print quality are the primary required attributes for this product.

The intermediate layer 16 comprises of one or more pigments dispersed in one or more binders. The basis weight of intermediate layer 16 may vary widely and any basis weight can be used to provide the desired effect on surface brightness z. The intermediate layer 16 provides an opacifying effect that reduces or prevents the show through of the lower brightness pulp forming base ply 12 thereby reducing the difference between brightness y and surface brightness z and increasing the difference between surface brightness z and brightness x. In general where the basis weights of plies 12 and 14 are constant, the greater the basis weight of intermediate layer 16 the lesser the difference between brightness y and surface brightness z and the greater the difference between surface brightness z and brightness x and the smaller the basis weight of intermediate layer 16 the greater the difference between brightness y and surface brightness z and the smaller the difference between surface brightness z and brightness x. Preferably, the basis weight of intermediate layer 16 can a range from about 0.5 lb per 1000 $ft^2$ to about 20 lb per 1000 $ft^2$. For example, the basis weight of intermediate layer 16 may have a range from about 0.75 lb per 1000 $ft^2$ to about 15 lb per 1000 $ft^2$. As a further example, the basis weight of intermediate layer 16 may have a range from about 1.0 lb per 1000 $ft^2$ to about 10 lb per 10 $ft^2$.

In the preferred embodiments of the invention, a portion of the pigment component of the intermediate layer 16 migrates into top ply 14 and a portion of the pigment component migrates into bottom ply 12. The amount of migration of the pigment into the top ply is usually not greater than about 20% by total weight of pigment and is preferably from about 0.5 to about 15% by total weight of pigment, more preferably from about 1 to about 10% by total weight of pigment and most preferably from about 1.5 to about 8% by total weight of pigment. The amount of migration of the pigment into the bottom ply is usually not less than about 50% by total weight of pigment and is preferably from about 50 to about 100% by total weight of pigment, more preferably from about 75 to about 100% by total weight of pigment and most preferably from about 85 to about 100% by total weight of pigment. The amount of migration of the binder component of the intermediate layer 16 into the top ply is usually not less than about 10% by total weight of binder and is preferably from about 10 to about 100% by total weight of binder, more preferably from about 15 to about 100% by total weight of binder and most preferably from about 30 to about 100% by total weight of binder. The amount of migration of the binder into the bottom ply is usually not more than about 80% by total weight of binder and is preferably from about 5 to about 80% by total weight of binder, more preferably from about 10 to about 75% by total weight of binder and most preferably from about 15 to about 70% by total weight of binder.

This migration of the binder and pigment in the preferred embodiments of the invention imparts favorable internal bond strength to the preferred multi-ply paper and paperboard of this invention. High internal bond strength is preferable since poor internal bond strength can be detrimental to the end use performance of the product. The internal bond strength can be measured using Tappi Test method T 569 pm-00 Internal Bond Strength (Scott type). The internal bond strength of the multiply paperboard is usually greater than about 50 ft-lbs*$10^{-3}$/in$^2$. In the preferred embodiments of the invention, the internal bond strength is greater than 55 ft-lbs*$10^{-3}$/in$^2$. In the more preferred embodiments of the invention, the internal bond strength is greater than about 60 ft-lbs*$10^{-3}$/in$^2$. In the most preferred embodiments of the invention, the internal bond strength is greater than about 70 ft-lbs*$10^{-3}$/in$^2$.

Useful binders may vary widely and include those normally used as binders in the manufacture of paper either internally or as a coating and are preferably either clear or white. Such binders are well known in the paper making art and will not be described in great detail. Illustrative of such binders are water soluble or water swellable macromolecular compounds such as starches, casein, gum arabic, sodium alginate, polyvinyl alcohol, polyvinyl pyrrolidone, sodium polyacrylates, and polyamides and resins soluble in organic solvents such as poly(vinyl butyral), poly(vinyl chloride), poly(vinylacetate), poly(acrylonitrile), poly(vinyl acetate), poly(methyl methacrylate), polyvinyl formate, melamine resins, polyamides, phenolic resins, polyurethane, latexes such as styrene-butadiene and alkyd resins.

In the preferred embodiments of this invention, the binder is a starch. Illustrative of useful starches for the practice of this preferred embodiment of the invention are naturally occurring carbohydrates synthesized in corn, tapioca, potato and other plants by polymerization of dextrose units. All such starches and modified forms thereof such as starch acetates, starch esters, starch ethers, starch phosphates, starch xanthates, anionic starches, cationic starches and the like which can be derived by reacting the starch with a suitable chemical or enzymatic reagent can be used in the practice of this invention.

Preferred starches for use in the practice of this invention are modified starches. More preferred starches are cationic modified or non-ionic starches such as CatoSize 270 and KoFilm 280 (all from National Starch) and chemically modified starches such as PG-280 ethylated starches and AP Pearl starches.

Useful pigments may vary widely and include those normally used as fillers in the manufacture of paper either internally or as a coating and are normally white. Illustrative of such pigments are calcium carbonate, titanium dioxide, clay, calcium silicate, barium sulphate, calcium sulphite, calcium sulphate, diatomaceous earth, talc and the like. Preferred pigments are calcium carbonate, titanium dioxide, clay, calcium silicate, barium sulphate, calcium sulphite, calcium sulphate, diatomaceous earth, and talc, more preferred pigments are calcium carbonate, titanium dioxide, clay, calcium silicate and talc and most preferred pigments are calcium carbonate, titanium dioxide, and clay.

The amount of pigment used may vary widely based on the desired optical and physical properties of the paperboard. For example the amount of pigment can be as low as about 5% by total weight of pigment and binder and lower to as high as about 90% by total weight of pigment and binder and higher. The amount of pigment is preferably from about 10 to about 80% by total weight of pigment and binder, more preferably from about 15 to about 70% by total weight of pigment and binder and most preferably from about 15 to about 50% by total weight of pigment and binder.

The particle size of the pigment may vary widely and any particle size typically employed in the art may be used. For example, the particle size can be as small as about 0.5 micron or less or as large as about 10 microns or more. Preferred particle size is from about 0.15 micron to about 7.5 microns and most preferred particle size in from about 0.2 micron to about 5 microns.

Similarly the specific surface area (BET) of the pigment particles may vary widely and those typically employed in the art may be used. For example, the specific surface area can be as low as about 1 m$^2$/g or lower and as high as about 50 m$^2$/g or higher. The preferred specific surface area is from about 1 m$^2$/g to about 25 m$^2$/g. The more preferred specific surface area is from about 1 m$^2$/g to about 20 m$^2$/g, and the most preferred specific surface area is from about 1 m$^2$/g to about 15 m$^2$/g.

The multi-ply paper or paperboard of this invention can be prepared by conventional techniques used to make multi-ply paper or paperboard products. Methods and apparatuses for multi-ply paper or paperboard products are well known in the paper and paperboard art. See for example "Handbook for Pulp & Paper Technologies", 2$^{nd}$ Edition, G. A. Smook, Angus Wilde Publications (1992) and references cited therein. Any conventional method and apparatus can be used. The papermaking process comprises three overall stages: wet end, forming section and dry end. The wet end includes the head boxes and the forming section includes the forming tables. The forming section is followed by the drying end which includes pressing, drying, calendering, and winding. White-top ply or linerboard 10 is typically formed on a paper machine capable of producing multi-ply product. One paper machine suitable for making a two-ply product is a conventional Fourdrinier machine.

Figure 2:
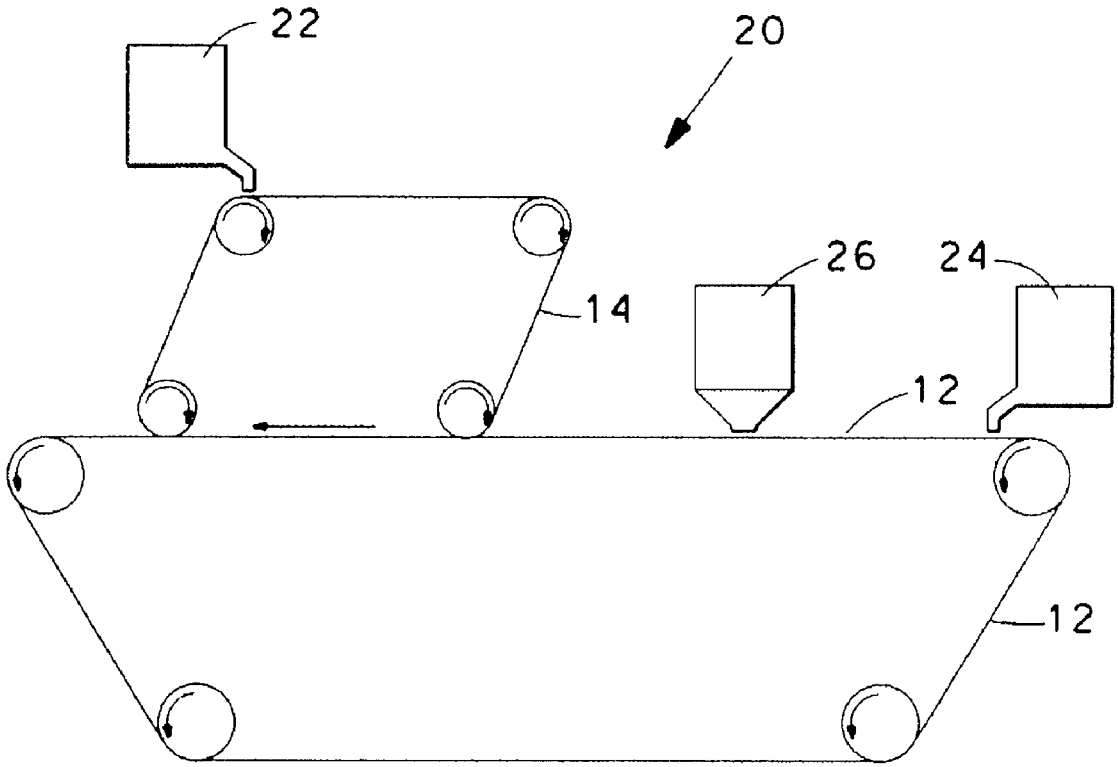
FIG. 2 is a portion of a Fourdrinier machine having two head boxes and a Hydra-Sizer® illustrating the bonding of a base ply with a top ply using an intermediate layer.

FIG. 2 is a portion of a Fourdrinier machine 20 having two head boxes 22 and 24 and a Hydra-Sizer® 26 illustrating the bonding of a base ply 12 with a top ply 14 using an intermediate layer 16. Each of the head box 24 and 22 contains furnish for the respective bottom and top ply 12 &14. Each of the head box 24 and 22 contains pulp slurry which is usually over 99% water. Starch and other chemical additives are generally added to furnish in the approach system of the paper machine prior to entering the head box. As noted above, a commercial piece of equipment capable of depositing such slurry onto a ply on forming section of a paper machine is GL&V's Hydra-Sizer® 26. The Hydra-Sizer® 26 features a special applicator that is positioned over the Fourdrinier machine 20, with an adjustable support structure, catch pan and additive supply system (not shown). A liquid dispersion of additive is forced out of a narrow slot in the applicator and falls as a full-width curtain onto the wet stock. The application of additives can be controlled to either disperse them through the sheet or keep them on the surface. In this application, the keeping additives on or near the mating surface of the ply being added to, is important to achieve the optical effect. The head box 24 deposits the bottom ply on a forming table of the Fourdrinier machine 20. At a suitable position along the forming table, vacuum is applied using conventional suction boxes and then the head box 22 adds a top ply 14 to the bottom ply 12. Water is removed by foils and by a suction roll. The web, typically having a solids content of 20-22%, exits the Fourdrinier machine and enters a conventional press section (not shown), which removes additional water (typically to a solids content of 38-42%). In the manufacture of white-top ply or linerboard, the top ply 12 furnish comprises bleached pulp, which can be either recycled or virgin or a combination thereof. The base ply 14 furnish is unbleached pulp, which can be either recycled or virgin or a combination thereof. Conventionally, the top layer 14 can be 5-60% of the total basis weight.

Another way to apply an intermediate layer 16 between the base ply 12 and top ply 14 of a multi-ply sheet 10 is to use the multi-wire fourdrinier paper machine 20. The forming section of this type of machine 20 consists of a number of separate headboxes and fourdrinier wires. The webs produced on each of these wires can then be combined together while still moist and then sent through the press section of the paper machine. In this manner the intermediate layer 16 can be formed on a wire and then placed between the base ply 12 and top ply 14. A suitable material to use as an intermediate layer 16 in a multi-wire fourdrinier paper machine can be sludge, which is a low-cost waste product from a paper mill. Sludge typically contains ligno cellulosics and filler, among other components, and when combined with a binder can be a suitable intermediate layer. Alternatively, the intermediate layer 16 may includes a layer of pigment sandwiched between two layers of starch. The intermediate layer 16 is then positioned between the base ply 12 and the top ply 14.

Following pressing, the two-ply web is dried in the main dryer section of the paper machine. It is sometimes common practice to then surface size the dried web at a size press (e.g., of the puddle or metering type) where the amount of pickup can be controlled. Sizing operations are carried out primarily to provide paper/paperboard with resistance to penetration by aqueous solutions. The treatment also improves the surface characteristics and certain physical properties of the paper/paperboard. During surface sizing, surface voids in the sheet are filled with starch or other binder particles. The size press can be any of the known types in the art. In the size press, the web passes through the nip between a pair of opposing size press rolls. The nip formed by the size press rolls is flooded with sizing solution supplied on both sides of the web by respective banks of solution supply tubes spaced in the sheet cross direction. The web absorbs some of the solution and the unabsorbed solution is removed by the pressure in the nip.

The multiply paper or paperboard of this invention can be used to make assorted products and in those applications for which such multi-ply products are conventionally used. Illustrative of such products and applications are corrugated cardboard and any product made with corrugated cardboard like corrugated containers and displays. Such products and applications are described in more detail in U.S. Pat. Nos. 5,792,317; 5,997,692; 5,985,030; 5,496,440; and 3,151,019.

The present invention will be described with references to the following examples. The examples are intended to be illustrative and the invention is not limited to the materials, conditions, or process parameters set forth in the example. All parts and percentages are by unit weight unless otherwise indicated.

In one embodiment, the intermediate layer 16 comprises organic and inorganic material. Organic material includes, for example, fiber and/or starch. Examples of inorganic material may be inorganic pigments. Inorganic pigments are, by way of example, minerals such as calcium carbonate, barium sulfate, titanium dioxide, calcium silicates, mica, kaolin and talc. The amount of organic and inorganic materials may vary widely based on the desired optical and physical properties of the paperboard. For example, the amount of organic material can be as low as about 5% by total weight of material and lower to as high as about 90% by total weight of material and higher. The amount of organic material is preferably from about 10% to about 80% by total weight of material, more preferably from about 15% to about 70% by total weight of material and most preferably from about 20% to about 60% by total weight of material. Similarly, the amount of inorganic material can be as high as about 95% by total weight of material and lower to about 10% by total weight of material and higher. The amount of inorganic material is preferably from about 90% to about 20% by total weight of material, more preferably from about 85% to about 30% by total weight of material and most preferably from about 80% to about 40% by total weight of material.

In the preferred embodiment of this invention, the intermediate layer 16 contains generally starch and pigment. Example of starches are cationic modified or non-ionic starches such as CatoSize 270 and KoFilm 280 (all from National Starch) and chemically modified starches such as PG-280 ethylated starches and AP Pearl starches. The amount of starch is preferably from about 10% to about 90% by total weight of starch and pigment, more preferably from about 20% to about 80% by total weight of starch and pigment and most preferably from about 25% to about 75% by total weight of starch and pigment.

In the most preferred embodiment of this invention, the intermediate layer 16 contains generally starch and calcium carbonate and the like. The amount of starch is preferably from about 10% to about 90% by total weight of starch and calcium carbonate, titanium dioxide, clay, calcium silicate, more preferably from about 20% to about 80% by total weight of starch and calcium carbonate and most preferably from about 25% to about 75% by total weight of starch and calcium carbonate.

The paper or paper product of this invention exhibits one or more beneficial properties. For example, certain embodiments of paper or paperboard of this invention exhibits MD Taber stiffness. Stiffness is readily measured by TAPPI-220 sp-06. In these preferred embodiments, the stiffness properties is at least from about 60 g-cm to about 120 g-cm, more preferably from about 70 g-cm to about 110 g-cm, most preferably from about 80 g-cm to about 100 g-cm.

For example, certain embodiments of paper or paperboard of this invention exhibits Mullen Index. Mullen Index is determined by procedure of TAPPI-818 cm-97. In these preferred embodiments, the Mullen Index is from about 80 psi to about 130 psi, more preferably from about 85 psi to about 125 psi, and most preferably from about 90 psi to about 120 psi.

For example, certain embodiments of paper or paperboard of this invention exhibits internal bond. Internal bond and other paper properties are readily measured by TAPPI-220 sp-06. In these preferred embodiments, the internal bond is from about 10 ft-lbs$*10^{-3}$/in$^2$ to about 120 ft-lbs$*10^{-3}$/in$^2$, more preferably from about 20 ft-lbs$*10^{-3}$/in$^2$ to about 110 ft-lbs$*10^{-3}$/in$^2$, most preferably from about 30 ft-lbs$*10^{-3}$/in$^2$ to about 100 ft-lbs$*10^{-3}$/in$^2$.

For example, in preferred embodiments of this invention the paper or paperboard will exhibits a geometric mean ring crush. Ring crush is determined by procedure of TAPPI-818 cm-97. In these preferred embodiments, the ring crush is from about 40 lbs to about 120 lbs, more preferably from about 50 lbs to about 110 lbs, and most preferably from about 60 lbs to about 100 lbs.

The intermediate layer 16 may comprise of one or more pigments dispersed in one or more binders. The basis weight of intermediate filler ply may vary widely and any basis weight can be used to provide the desired effect on surface brightness z. The intermediate filler ply provides an opacifying effect that reduces or prevents the show through of the lower brightness pulp forming base ply thereby reducing or increasing the difference between brightness y and surface brightness z and increasing the difference between surface brightness z and brightness x.

EXAMPLE 1

White top linerboard samples were prepared in the laboratory using commercially produced pulps. The samples were made on a laboratory dynamic sheet former. First a 42 lb/1000 $ft^2$ control white top linerboard sample was made (Sheet 1). This sheet had a 27 lb/1000 $ft^2$ bottom ply and a 15 lb/1000 top ply. The bottom ply was made with 100% unbleached pulp and the top ply was made with 95% bleached pulp and 5% precipitated calcium carbonate. A second 42 lb/1000 $ft^2$ white top linerboard sample was made with a 27 lb/1000 $ft^2$ bottom ply 12, a 2 lb/1000 $ft^2$ intermediate layer 16 and a 13 lb/1000 $ft^2$ top ply 14 (Sheet 2). The bottom ply was made with 100% unbleached pulp, the intermediate layer 16 was made with a mixture of 70% uncooked starch and 30% calcium carbonate and the top ply was made with 95% bleached pulp and 5% precipitated calcium carbonate. A third 42 lb/1000 $ft^2$ white top linerboard sample was made with a 27 lb/1000 $ft^2$ bottom ply and a 13 lb/1000 $ft^2$ top ply (Sheet 3). The bottom ply was made with 100% unbleached pulp and the top ply was made with 95% bleached pulp and 5% precipitated calcium carbonate. The brightness of the top ply was measured for each sheet and recorded in Table 1.

TABLE 1

Brightness of white top linerboard samples.

| Sheet ID | Bottom Ply Basis Weight, lb/1000 $ft^2$ | Intermediate layer Basis Weight, lb/1000 $ft^2$ | Top Ply Basis Weight, lb/1000 $ft^2$ | GE Brightness, % |
|---|---|---|---|---|
| Sheet 1 | 27 | 0 | 15 | 79.5 |
| Sheet 2 | 27 | 2 | 13 | 79.9 |
| Sheet 3 | 27 | 0 | 13 | 76.9 |

The brightness measurement is an indicator of how well the top ply hides the brown color of the bottom ply. Reducing the basis weight of the top ply by 2 lb/1000 $ft^2$ causes the brightness to decrease 2.6 points from 79.5 to 76.9. This loss in brightness, however, can be overcome by adding the Intermediate layer containing calcium carbonate. Adding the intermediate layer of calcium carbonate and starch increased the brightness 79.9. This example demonstrates the opportunity to reduce the basis weight of the top ply, while maintaining acceptable brightness of the top ply.

EXAMPLE 2

White top linerboard samples were prepared in the laboratory using commercially produced pulps. The samples were made on a laboratory dynamic sheet former. First a 42 lb/1000 $ft^2$ control white top linerboard sample was made (Sheet 4). This sheet had a 27 lb/1000 $ft^2$ bottom ply and a 15 lb/1000 top ply. The bottom ply was made with 100% unbleached pulp and the top ply was made with 95% bleached pulp and 5% precipitated calcium carbonate. A second 42 lb/1000 $ft^2$ white top linerboard sample was made with a 27 lb/1000 $ft^2$ bottom ply, a 2 lb/1000 $ft^2$ Intermediate layer and a 13 lb/1000 $ft^2$ top ply (Sheet 5). The bottom ply was made with 100% unbleached pulp, the Intermediate layer was made with a 100% calcium carbonate and the top ply was made with 95% bleached pulp and 5% precipitated calcium carbonate. A third 42 lb/1000 $ft^2$ white top linerboard sample was made with a 27 lb/1000 $ft^2$ bottom ply, a 2 lb/1000 $ft^2$ Intermediate layer and a 13 lb/1000 $ft^2$ top ply (Sheet 6). The bottom ply was made with 100% unbleached pulp, the intermediate layer was made with a mixture of 25% uncooked starch and 75% calcium carbonate and the top ply was made with 95% bleached pulp and 5% precipitated calcium carbonate. A fourth 42 lb/1000 $ft^2$ white top linerboard sample was made with a 27 lb/1000 $ft^2$ bottom ply, a 2 lb/1000 $ft^2$ Intermediate layer and a 13 lb/1000 $ft^2$ top ply (Sheet 7). The bottom ply was made with 100% unbleached pulp, the intermediate layer was made with a mixture of 50% uncooked starch and 50% calcium carbonate and the top ply was made with 95% bleached pulp and 5% precipitated calcium carbonate. A fifth 42 lb/1000 $ft^2$ white top linerboard sample was made with a 27 lb/1000 $ft^2$ bottom ply, a 2 lb/1000 $ft^2$ intermediate layer and a 13 lb/1000 $ft^2$ top ply (Sheet 8). The bottom ply was made with 100% unbleached pulp, the Intermediate layer was made with a mixture of 75% uncooked starch and 25% calcium carbonate and the top ply was made with 95% bleached pulp and 5% precipitated calcium carbonate. A sixth 42 lb/1000 $ft^2$ white top linerboard sample was made with a 27 lb/1000 $ft^2$ bottom ply, a 2 lb/1000 $ft^2$ Intermediate layer and a 13 lb/1000 $ft^2$ top ply (Sheet 9). The bottom ply was made with 100% unbleached pulp, the intermediate layer was made with 100% uncooked starch and the top ply was made with 95% bleached pulp and 5% precipitated calcium carbonate. The brightness of the top ply and the internal bond strength of each sheet was measured and recorded in Table 2.

TABLE 2

Brightness and internal bond of white top linerboard samples.

| Sheet ID | Bottom Ply Basis Weight, lb/1000 $ft^2$ | Intermediate layer Basis Weight, lb/1000 $ft^2$ | Top Ply Basis Weight, lb/1000 $ft^2$ | GE Brightness, % | Internal Bond, 1 E-3 ft*lb/$in^2$ |
|---|---|---|---|---|---|
| Sheet 4 | 27 | 0 | 15 | 81.0 | 63 |
| Sheet 5 | 27 | 2 | 13 | 83.2 | 0 |
| Sheet 6 | 27 | 2 | 13 | 82.5 | 22 |
| Sheet 7 | 27 | 2 | 13 | 81.5 | 68 |
| Sheet 8 | 27 | 2 | 13 | 81 | 92 |
| Sheet 9 | 27 | 2 | 13 | 79.5 | 85 |

This example illustrates that there is an optimal mixture of uncooked starch and calcium carbonate in which the bond strength and brightness are not significantly different from the standard white top sample with no Intermediate layer. This is further demonstrated in FIG. 1, which is a plot of the data in Table 2. Increasing the percent of starch in the intermediate layer mixture increases the bond strength but reduces the brightness. Conversely, increasing the percent of calcium carbonate in the intermediate layer decreases the bond strength and increases the brightness. While the higher brightness is desirable it also reduces the bond strength, which is undesirable to an end-user. The graph clearly shows that there is an optimal mixture of uncooked starch and calcium carbonate that results in the desired brightness and internal bond properties. More specifically, the graph shows that to achieve the brightness of the standard white top linerboard, the mid-ply must contain at least about 30% calcium carbonate. And to achieve the internal bond strength of the standard white top linerboard, the intermediate layer must contain at least about 50% uncooked starch.

EXAMPLE 3

White top linerboard samples were prepared in the laboratory using commercially produced pulps. The samples were made on a laboratory dynamic sheet former. First a 42 lb/1000 $ft^2$ control white top linerboard sample was made (Sheet 4). This sheet had a 27 lb/1000 $ft^2$ bottom ply and a 15 lb/1000 top ply. The bottom ply was made with 100% unbleached pulp and the top ply was made with 95% bleached pulp and 5% precipitated calcium carbonate. A second 42 lb/1000 $ft^2$ white top linerboard sample was made with a 27 lb/1000 $ft^2$ bottom ply, a 1 lb/1000 $ft^2$ intermediate layer and a 14 lb/1000 $ft^2$ top ply (Sheet 10). The bottom ply was made with 100% unbleached pulp, the Intermediate layer was made with a mixture of 75% uncooked starch and 25% calcium carbonate and the top ply was made with 95% bleached pulp and 5% precipitated calcium carbonate. A third 42 lb/1000 $ft^2$ white top linerboard sample was made with a 27 lb/1000 $ft^2$ bottom ply, a 2 lb/1000 $ft^2$ Intermediate layer and a 13 lb/1000 $ft^2$ top ply (Sheet 11). The bottom ply was made with 100% unbleached pulp, the Intermediate layer was made with a mixture of 75% uncooked starch and 25% calcium carbonate and the top ply was made with 95% bleached pulp and 5% precipitated calcium carbonate. A fourth 42 lb/1000 $ft^2$ white top linerboard sample was made with a 27 lb/1000 $ft^2$ bottom ply, a 3 lb/1000 $ft^2$ intermediate layer and a 12 lb/1000 $ft^2$ top ply (Sheet 12). The bottom ply was made with 100% unbleached pulp, the intermediate layer was made with a mixture of 75% uncooked starch and 25% calcium carbonate and the top ply was made with 95% bleached pulp and 5% precipitated calcium carbonate. A fifth 42 lb/1000 $ft^2$ white top linerboard sample was made with a 27 lb/1000 $ft^2$ bottom ply, a 4 lb/1000 $ft^2$ intermediate layer and an 11 lb/1000 $ft^2$ top ply (Sheet 13). The bottom ply was made with 100% unbleached pulp, the intermediate layer was made with a mixture of 75% uncooked starch and 25% calcium carbonate and the top ply was made with 95% bleached pulp and 5% precipitated calcium carbonate. The brightness of the top ply and the internal bond strength of each sheet was measured and recorded in Table 3 and plotted in FIG. 2.

TABLE 3

Brightness and internal bond of white top linerboard samples.

| Sheet ID | Bottom Ply Basis Weight, lb/1000 $ft^2$ | Intermediate layer Basis Weight, lb/1000 $ft^2$ | Top Ply Basis Weight, lb/1000 $ft^2$ | GE Brightness, % | Internal Bond, 1E-3 ft*lb/$in^2$ |
|---|---|---|---|---|---|
| Sheet 4 | 27 | 0 | 15 | 81.0 | 63 |
| Sheet 10 | 27 | 1 | 14 | 81.5 | 73 |
| Sheet 11 | 27 | 2 | 13 | 80.6 | 96 |
| Sheet 12 | 27 | 3 | 12 | 79.8 | 105.5 |
| Sheet 13 | 27 | 4 | 11 | 78.7 | 105.5 |

This data reveals that there is an optimal intermediate layer percentage of the total sheet that is important to meet the desired brightness. With a intermediate layer composition of 75% starch and 25% calcium carbonate once the Intermediate layer percentage becomes greater than about 5%, the brightness becomes lower than the standard white top liner. The internal bond strength continues to rise with an increasing amount of this intermediate layer.

EXAMPLE 4

White top linerboard samples were prepared in the laboratory using commercially produced pulps. The samples were made on a laboratory dynamic sheet former. First a 42 lb/1000 $ft^2$ control white top linerboard sample was made (Sheet 4). This sheet had a 27 lb/1000 $ft^2$ bottom ply and a 15 lb/1000 $ft^2$ top ply. The bottom ply was made with 100% unbleached pulp and the top ply was made with 95% bleached pulp and 5% precipitated calcium carbonate. A second 42 lb/1000 $ft^2$ white top linerboard sample was made with a 27 lb/1000 $ft^2$ bottom ply, a 2 lb/1000 $ft^2$ intermediate layer and a 13 lb/1000 $ft^2$ top ply (Sheet 11). The bottom ply was made with 100% unbleached pulp, the intermediate layer was made with a mixture of 75% uncooked starch and 25% calcium carbonate and the top ply was made with 95% bleached pulp and 5% precipitated calcium carbonate. A third 42 lb/1000 $ft^2$ white top linerboard sample was made with a 27 lb/1000 $ft^2$ bottom ply, and a 15 lb/1000 $ft^2$ top ply (Sheet 14). The bottom ply was made with 100% unbleached pulp and the top ply was made with 13 lb/1000 $ft^2$ 95% bleached pulp and 5% precipitated calcium carbonate and 2 lb/1000 $ft^2$ of a mixture of 75% uncooked starch and 25% calcium carbonate. The brightness of the top ply and the internal bond strength of each sheet was measured and recorded in Table 4.

TABLE 4

Brightness and internal bond of white top linerboard samples.

| Sheet ID | Bottom Ply Basis Weight, lb/1000 $ft^2$ | Intermediate layer Basis Weight, lb/1000 $ft^2$ | Top Ply Basis Weight, lb/1000 $ft^2$ | GE Brightness, % | Internal Bond, 1E-3 ft*lb/$in^2$ |
|---|---|---|---|---|---|
| Sheet 4 | 27 | 0 | 15 | 81.0 | 63 |
| Sheet 11 | 27 | 2 | 13 | 80.6 | 96 |
| Sheet 14 | 27 | 0 | 15 | 80.1 | 101 |

This example shows that by adding the composition of Intermediate layer in Sheet 11 to the top ply layer of Sheet 14, similar properties in brightness and internal bond can be achieved.

EXAMPLE 5

White top linerboard samples were prepared on a commercial multi-ply paperboard paper machine using commercially produced pulps. The control sample is white top linerboard produced under conventional conditions. The trial sample is white top linerboard produced with 5% of the total basis weight reduced from the top ply and 5% of the total basis weight added as a mixture of uncooked starch and calcium carbonate. The mixture of uncooked starch and calcium carbonate was 75% uncooked starch and 25% calcium carbonate. The mixture was sprayed onto the bottom ply with a Hydra-Sizer®. The properties of the white top linerboard samples are presented in Table 5.

TABLE 5

Sheet properties from commercially produced white top linerboard samples.

| | Control | Trial |
|---|---|---|
| Internal Bond | 163 | 137 |
| Peel | 115 | 101 |
| Brightness | 73.2 | 73.1 |
| Ring Crush | 66 | 73 |
| Mullen | 92 | 94 |

The commercially produced samples of white top linerboard gave a similar response in brightness as the laboratory produced samples. Important sheet properties like Ring Crush and Mullen were not affected. Bond strength and peel strength were lower in the trial sample, however, the failure mechanism of these tests have changed. The Control sample failed in the top ply as evidenced from the white fiber being present in the bottom ply. In the Trial sample, the failure occurred in the bottom ply as evidenced from no white fibers being present in the bottom ply and brown fibers being present in the top ply. This change in failure mechanism was unexpected.

EXAMPLE 6

The Control and Trial white top linerboard described n Example 5 were converted into corrugated board, which were further converted into corrugated containers. An important end-user property of these corrugated containers is that the glue joint that is formed on one edge of the box have sufficient strength that is does not failure when in use. The joint strength is tested by tearing the joint and studying how the joint fails. If it fails in the top ply, the joint is considered bad. If it fails in the bottom ply, then the joint is considered good.

The Control white top linerboard failed in the top ply while the Trial white top linerboard failed in the bottom ply. This was evidenced from inspecting the samples after tearing the joint. The Control sample had white fibers in the bottom ply indicating that the failure occurred in the top ply. The Trial sample had brown fibers in the top ply indicating that the failure occurred in the bottom ply. This indicates that the glue joint of the Trial white top liner is a better joint than the Control white top linerboard. This was an unexpected result because putting a Intermediate layer of calcium carbonate between the top and bottom plies should adversely affect the glue joint strength. Unexpectedly the joint was improved.

EXAMPLE 7

Figure 3:
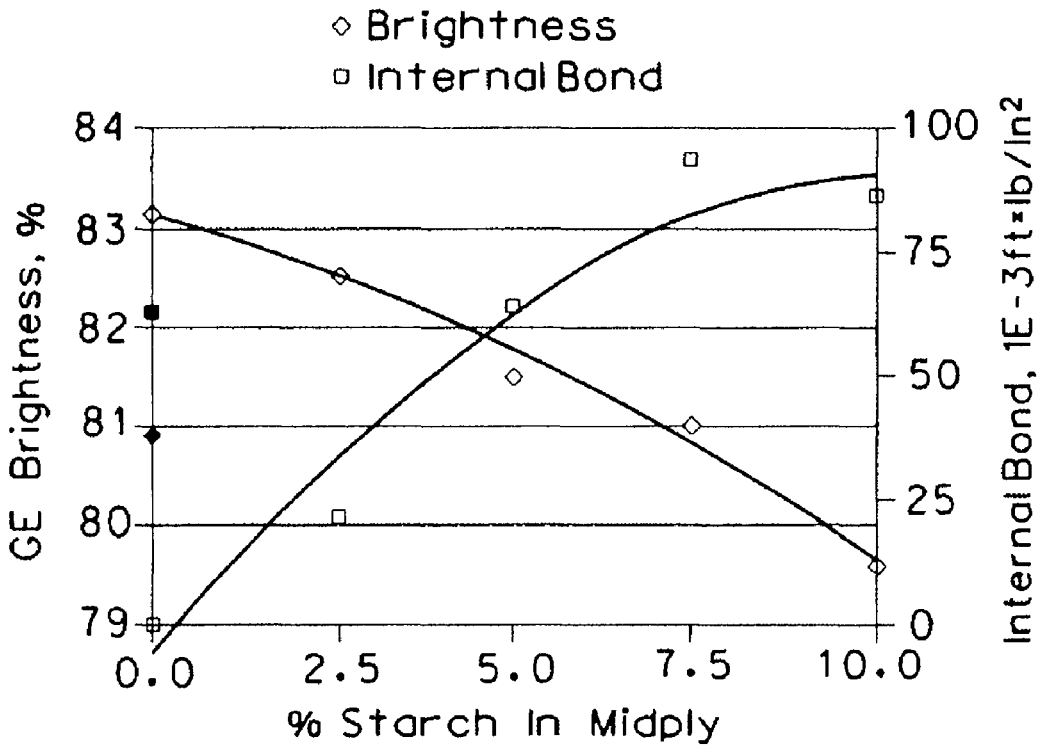
FIG. 3 illustrates the brightness and internal bond of the white top linerboard samples plotted as a function of Intermediate layer starch composition.
Figure 4:
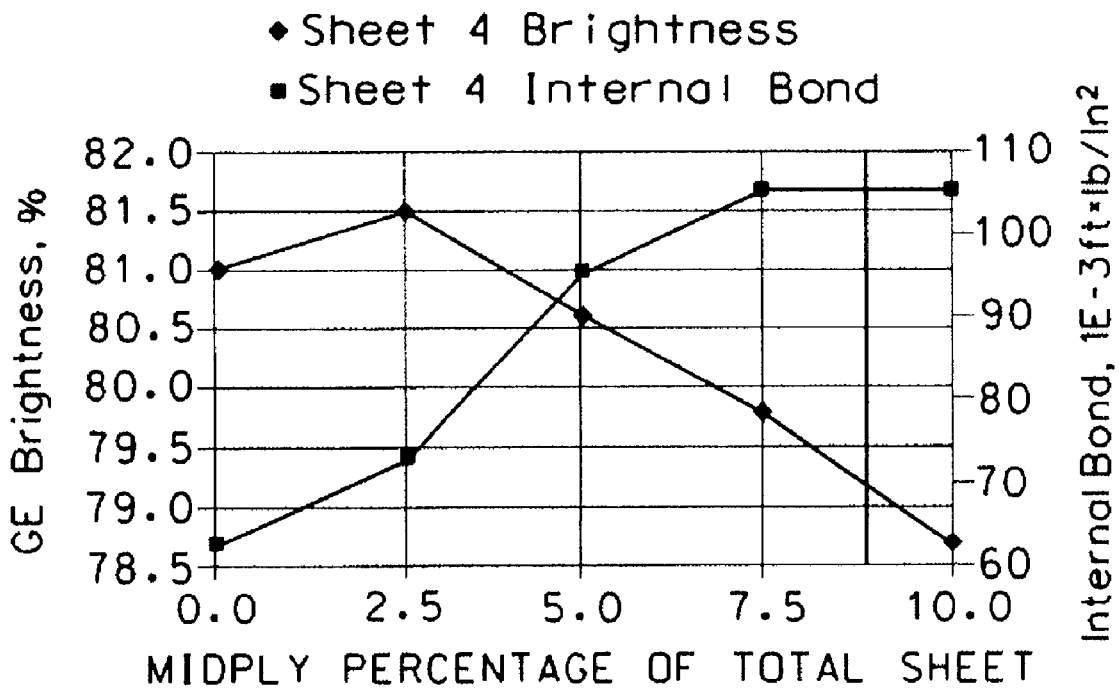
FIG. 4 illustrates the brightness and internal bond strength of white top liner with 25/75 PCC/starch mid-ply.
Figure 5:
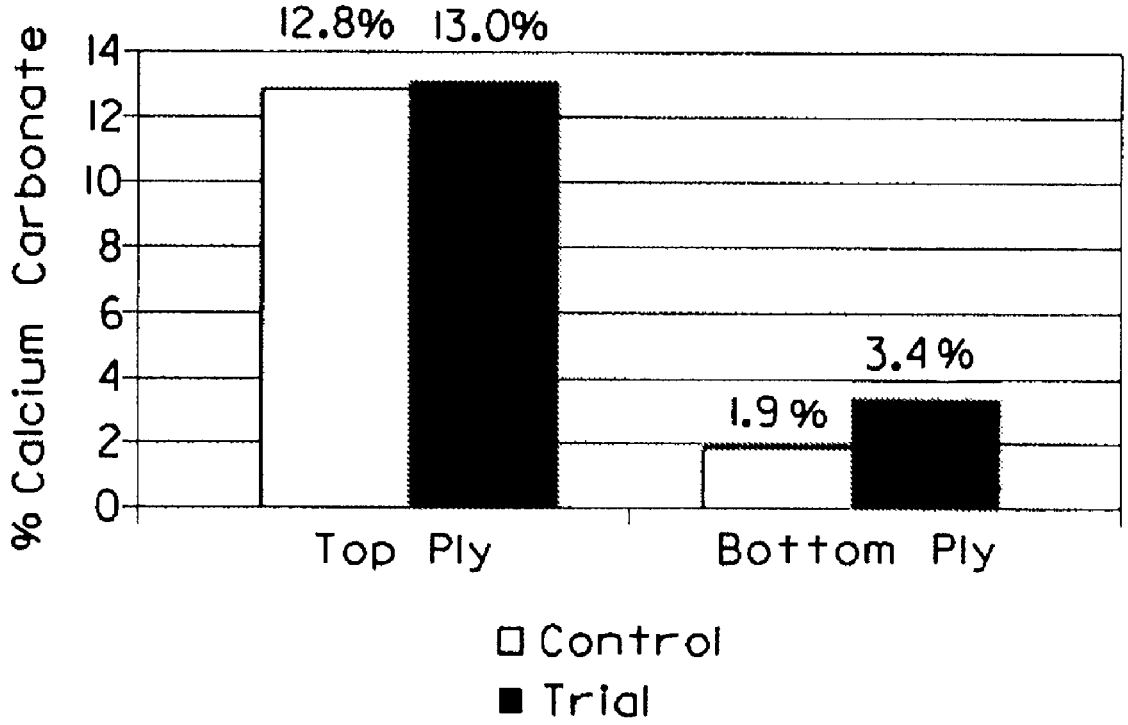
FIG. 5 illustrates the calcium carbonate content of top and bottom plies from control and trial white top linerboard.
Figure 6:
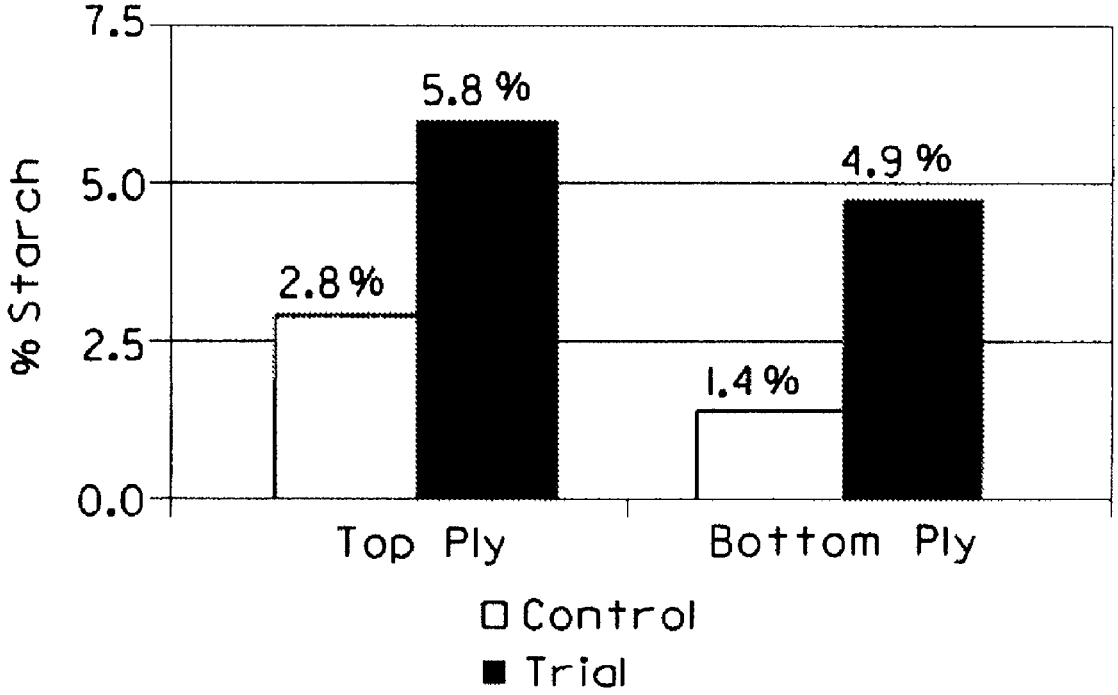
FIG. 6 illustrates the starch content of top and bottom plies from control and trail white top linerboard.
Figure 7:
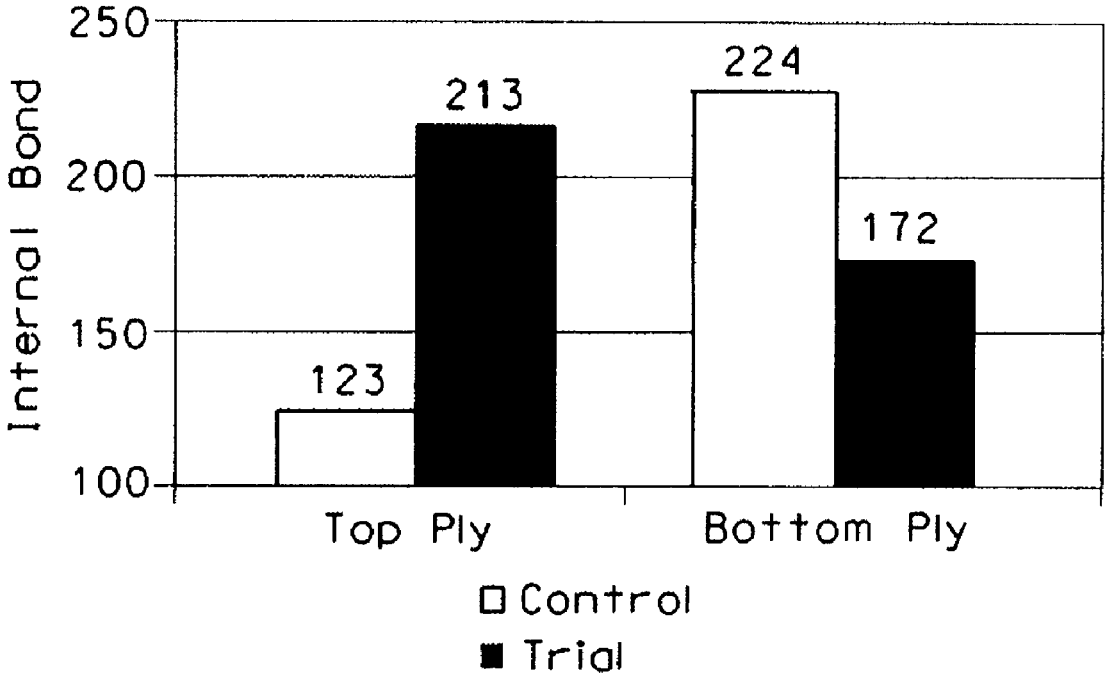
FIG. 7 illustrates the internal bond strength of top and bottom plies from control and white top linerboard.

Samples of Control and Trial white top linerboard from Example 5 were split between the top and bottom plies so that their contents of calcium carbonate and starch could be quantified. The internal bond strength of these individual plies was also measured. The results are presented in Table 6 and plotted in FIGS. 3, 4 and 5.

TABLE 6

Calcium carbonate content, starch content and internal bond strength of top and bottom plies from Control and Trial white top linerboard.

| | Calcium Carbonate Content, % | | Starch Content, % | | Internal Bond, ft lb/1000 sq in | |
|---|---|---|---|---|---|---|
| | Top Ply | Bottom Ply | Top Ply | Bottom Ply | Top Ply | Bottom Ply |
| Control | 12.8 | 1.9 | 2.8 | 1.4 | 123 | 224 |
| Trial | 13 | 3.4 | 5.8 | 4.9 | 213 | 172 |

EXAMPLE 8

White top linerboard samples were prepared in the laboratory using commercially produced pulps. The samples were made on a laboratory dynamic sheet former. First a 42 lb/1000 $ft^2$ control white top linerboard sample was made (Sheet 80). This sheet had a 27 lb/1000 $ft^2$ bottom ply and a 15 lb/1000 top ply. The bottom ply was made with 100% unbleached pulp and the top ply was made with 95% bleached pulp and 5% precipitated calcium carbonate.

A second 42 lb/1000 $ft^2$ white top linerboard sample was made with a 27 lb/1000 $ft^2$ bottom ply, a 1 lb/1000 $ft^2$ Intermediate layer and a 14 lb/1000 $ft^2$ top ply (Sheet 81). The bottom ply was made with 100% unbleached pulp, the Intermediate layer was made with a mixture of 75% deinked sludge and 25% uncoated freesheet sludge and the top ply was made with 95% bleached pulp and 5% precipitated calcium carbonate.

A third 42 lb/1000 $ft^2$ white top linerboard sample was made with a 27 lb/1000 $ft^2$ bottom ply, a 2 lb/1000 $ft^2$ Intermediate layer and a 13 lb/1000 $ft^2$ top ply (Sheet 82). The bottom ply was made with 100% unbleached pulp, the Intermediate layer was made with a mixture of 75% deinked sludge and 25% uncoated freesheet sludge and the top ply was made with 95% bleached pulp and 5% precipitated calcium carbonate.

A fourth 42 lb/1000 $ft^2$ white top linerboard sample was made with a 27 lb/1000 $ft^2$ bottom ply, a 3 lb/1000 $ft^2$ Intermediate layer and a 12 lb/1000 $ft^2$ top ply (Sheet 83). The bottom ply was made with 100% unbleached pulp, the Intermediate layer was made with a mixture of 75% deinked sludge and 25% uncoated freesheet sludge and the top ply was made with 95% bleached pulp and 5% precipitated calcium carbonate.

A fifth 42 lb/1000 $ft^2$ white top linerboard sample was made with a 27 lb/1000 $ft^2$ bottom ply, a 4 lb/1000 $ft^2$ Intermediate layer and an 1 lb/1000 $ft^2$ top ply (Sheet 84). The bottom ply was made with 100% unbleached pulp, the Intermediate layer was made with a mixture of 75% deinked sludge and 25% uncoated freesheet sludge and the top ply was made with 95% bleached pulp and 5% precipitated calcium carbonate.

A sixth 40 lb/1000 $ft^2$ white top linerboard sample was made with a 27 lb/1000 $ft^2$ bottom ply and a 13 lb/1000 $ft^2$ top ply (Sheet 85). The bottom ply was made with 100% unbleached pulp and the top ply was made with 95% bleached pulp and 5% precipitated calcium carbonate.

A seventh 38 lb/1000 $ft^2$ white top linerboard sample was made with a 27 lb/1000 $ft^2$ bottom ply and a 11 lb/1000 $ft^2$ top ply (Sheet 86). The bottom ply was made with 100% unbleached pulp and the top ply was made with 95% bleached pulp and 5% precipitated calcium carbonate.

The brightness of the top ply and the internal bond strength of each sheet was measured and recorded in Table 7.

TABLE 7

Brightness and internal bond of white top linerboard samples.

| Sheet ID | Bottom Ply Basis Weight, lb/1000 $ft^2$ | Intermediate layer Basis Weight, lb/1000 $ft^2$ | Top Ply Basis Weight, lb/1000 $ft^2$ | GE Brightness, % | Internal Bond, 1E-3 ft*lb/$in^2$ |
|---|---|---|---|---|---|
| Sheet 80 | 27 | 0 | 15 | 76.7 | 96 |
| Sheet 81 | 27 | 1 | 14 | 76.8 | 62 |
| Sheet 82 | 27 | 2 | 13 | 76.0 | 16 |
| Sheet 83 | 27 | 3 | 12 | 76.1 | 14 |
| Sheet 84 | 27 | 4 | 11 | 75.7 | 15 |
| Sheet 85 | 27 | 0 | 13 | 75.1 | 70 |
| Sheet 86 | 27 | 0 | 11 | 72.1 | 65 |

This example shows that by using sludge (a waste product from a deinked plant and/or an uncoated freesheet mill) as a midply can allow for a reduction in top ply basis weight while maintaining brightness. Sludge is chiefly composed of fillers like calcium carbonate or clay and lignocellulosic material. An analysis of the uncoated freesheet sludge found that the sludge contained 66% filler and 34% lignocellulosic material. The filler may include, among others, about 50% calcium carbonate, and the reminder of the filler are barium sulfate, titanium dioxide, calcium silicates, mica, kaolin and talc. The filler was chiefly composed of PCC but other fillers were also present in the sludge. The presence of fillers in the sludge makes it a suitable material for a Intermediate layer in white top linerboard to achieve the desired brightness with the lower top ply basis weight. However, the sludge in the Intermediate layer significantly reduced the internal bond strength of the multiply sheet.

EXAMPLE 9

White top linerboard samples were prepared in the laboratory using commercially produced pulps. The samples were made on a laboratory dynamic sheet former. First a 42 lb/1000 $ft^2$ control white top linerboard sample was made with a typical dosage of cationic starch for bond strength (Sheet 90). This sheet had a 27 lb/1000 $ft^2$ bottom ply and a 15 lb/1000 top ply. 14 lb/T of cationic starch was added to the bottom ply and 30 lb/ton of cationic starch was added to the top ply.

A second 42 lb/1000 $ft^2$ control white top linerboard sample was made with sludge in the Intermediate layer and cationic starch added to each ply (Sheet 91). This sheet had a 27 lb/1000 $ft^2$ bottom ply, a 4 lb/1000 $ft^2$ Intermediate layer and an 11 lb/1000 $ft^2$ top ply. 11 lb/T of cationic starch was added to the bottom ply, 50 lb/ton of cationic starch was added to the Intermediate layer and 30 lb/ton of cationic starch was added to the top ply. These dosages resulted in the same total starch dosage as in Sheet 90. The internal bond strength was measured in each sheet and reported in Table 8.

TABLE 8

Internal bond strength of white top linerboard samples with cationic starch.

| Sheet ID | Bottom Ply Basis Weight, lb/1000 ft$^2$ | Intermediate layer Basis Weight, lb/1000 ft$^2$ | Top Ply Basis Weight, lb/1000 ft$^2$ | Cationic Starch Dosage, lb/T Bottom | Mid | Top | Internal Bond, 1E-3 ft*lb/in$^2$ |
|---|---|---|---|---|---|---|---|
| Sheet 90 | 27 | 0 | 15 | 14 | 0 | 30 | 60 |
| Sheet 91 | 27 | 4 | 11 | 11 | 50 | 30 | 64 |

Example 8 showed that a intermediate layer with sludge reduces the internal bond strength. For example Sheet 80 with no Intermediate layer had 96 internal bond strength while Sheet 84 with a intermediate layer of sludge had 15 bond strength. The internal bond of Sheet 91 suggests that by adding cationic starch to the Intermediate layer, the internal bond strength can be increased to the same level as the control with no Intermediate layer.

EXAMPLE 10

Other physical properties of the White Top Linerboard samples were measured. The properties are presented in Table 9.

TABLE 9

Various strength properties of White Top Linerboard samples.

| Sheet ID | Mullen, psi | Ring Crush, lbs. | MD Taber Stiffness, g-cm | Internal Bond, 1E-3 ft*lb/in2 |
|---|---|---|---|---|
| Sheet 80 | 119 | 82 | 80 | 96 |
| Sheet 81 | 103 | 71 | 57 | 62 |
| Sheet 82 | 115 | 71 | 38 | 16 |
| Sheet 83 | 104 | 69 | 31 | 14 |
| Sheet 84 | 107 | 65 | 36 | 15 |
| Sheet 85 | 123 | 72 | 62 | 70 |
| Sheet 86 | 109 | 73 | 66 | 65 |
| Sheet 90 | 116 | 78 | 84 | 60 |
| Sheet 91 | 110 | 84 | 95 | 64 |

The results found that in the Trial white top linerboard the content of calcium carbonate increased in the bottom ply but not the top ply. The results also found that the content of starch increased in both plies. The results also found that the internal bond strength increased in the top ply and decreased in the bottom ply. These results were unexpected as it was expected that there would be an equal distribution of starch and calcium carbonate into the top and bottom plies. However, these results show that the calcium carbonate preferentially migrated into the base sheet while the starch migrated similarly into both plies. These results suggest that the reason why the top ply bond strength increased was due to the increased content of starch along with the negligible change to the calcium carbonate content. These results also suggest that the reason why the bottom ply internal bond decreased was due to the increase in calcium carbonate content in the bottom ply.

These results help to interpret the observations in Examples 5 and 6. These examples showed that the failure mechanism of internal bond, peel and glue joint failure changed when a Intermediate layer of calcium carbonate and uncooked starch was applied between the top and bottom plies of white top linerboard. These failure mechanisms apparently changed because all the calcium carbonate in the Intermediate layer migrated into the base sheet and the starch migrated into both the base sheet and the top ply. Calcium carbonate interrupts the bonding sites and thus reduces the bond strength. Starch, on the other hand, helps bonding and thus increased the bond strength. Therefore, the top ply bond strength increased because of the increased content of starch and the bottom ply bond strength decreased because of the increased content of calcium carbonate.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A paper or paperboard substrate having substantially parallel top and bottom surfaces consisting of:

a base ply having top and bottom surfaces, the base ply comprising ligno cellulosic fibers having a first brightness x;

a top ply having a substantially white color top and bottom surfaces, the top ply comprising ligno cellulosic fibers having a second brightness y which is greater than the first brightness x and wherein the top surface of the top ply forms the top surface of the paperboard substrate; and an intermediate layer having top and bottom surfaces, the intermediate layer positioned between the top and base plies to reduce a basis weight of the top ply, the intermediate layer comprising from about 50% to about 70% by weight of organic and from about 30% to about 50% by weight of inorganic material, wherein the intermediate layer is configured such that the paper or paperboard substrate has a top surface third brightness z and wherein the third brightness z is greater than the first brightness x and is equal to or less than the second brightness y.

2. The paper or paperboard substrate of claim 1 wherein the paperboard substrate consisting of the top ply, the base ply and the intermediate layer, wherein the bottom surface of the intermediate layer is bonded to the top surface of the base ply and the top surface of the intermediate layer is bonded to the bottom surface of the top ply.

3. The paper or paperboard substrate of claim 1 wherein each of the top ply and base ply have a basis weight of from about 5 to about 300 lb/1000 $ft^2$ and wherein the ratio of the basis weight of the top ply to the basis weight of the base ply is about 10:90 to about 97:3.

4. The paper or paperboard substrate of claim 3 wherein each of the top ply and base ply have a basis weight of from about 20 to about 150 lb/1000 $ft^2$ and wherein the ratio of the basis weight of the top ply to the basis weight of the base ply is from about 20:80 to about 95:5.

5. The paper or paperboard substrate of claim 4 wherein each of the top ply and base ply have a basis weight of from about 26 to about 69 lb/1000 $ft^2$ and wherein the ratio of the basis weight of the top ply to the basis weight of the base ply is from about 60:40 to about 80:20.

6. The paper or paperboard substrate of claim 1 wherein the binder is selected from the group consisting of starch, casein, gum arabic, sodium alginate, polyvinyl alcohol, polyvinyl pyrrolidone, sodium polyacrylates, and polyamides and resins soluble in organic solvents such as poly(vinyl butyral), poly(vinyl chloride), poly(vinylacetate), poly(acrylonitrile), poly(vinyl acetate), poly(methyl methacrylate), polyvinyl formate, melamine resins, polyamide, phenolic resins, polyurethane, latexes such as styrene-butadiene and alkyd resins or any combination thereof.

7. The paper or paperboard substrate of claim 1 wherein the pigment is selected from the group consisting calcium carbonate, titanium dioxide, clay, calcium silicate, barium sulphate, calcium sulphite, calcium sulphate, diatomaceous earth, talc and any combination thereof.

8. The paper or paperboard substrate of claim 7 wherein the pigment is calcium carbonate.

9. The paper or paperboard substrate of claim 8 wherein the binder is a starch.

10. The paper or paperboard substrate of claim 1 wherein a portion of the pigment component migrates into the top ply and a portion of the pigment component migrate into bottom ply and wherein the amount of migration of pigment into top ply is not greater than about 20% by total weight of pigment.

11. The paper or paperboard substrate of claim 10 wherein the amount of migration of the pigment into bottom ply is not less than about 50% by total weight of pigment.

12. The paper or paperboard substrate of claim 1 wherein the brightness z is no more than 20 brightness units less than brightness y and brightness x is from about 5 to about 70 brightness units than less brightness y.

13. The paper or paperboard substrate of claim 1 wherein brightness z is no more than 10 brightness units less then brightness y and brightness x is from about 10 to about 50 brightness units less than brightness y.

14. The paper or paperboard substrate of claim 1 wherein brightness z is no more than 5 brightness units less than brightness y and brightness x is from about 10 to about 30 brightness units than less brightness y.

15. The paper or paperboard substrate of claim 1 wherein the base ply is present in an amount from about 50% to about 80% by weight of the paper or paperboard substrate.

16. The paper or paperboard substrate of claim 1 wherein the intermediate layer is present in an amount ranging from 0% to 20% by weight of the paper or paperboard substrate.

17. The paper or paperboard substrate of claim 1 wherein the top ply is present in an amount from about 20% to about 40% by weight of the paper or paperboard substrate.

18. The paper or paperboard substrate of claim 1 wherein the organic material is binder.

19. The paper or paperboard substrate of claim 1 wherein the inorganic material is pigment.

20. The paper or paperboard substrate of claim 1 wherein the intermediate layer comprise polymeric binder and pigment.

21. The paper or paperboard substrate of claim 1 wherein the substrate has a stiffness from about 60 g-cm to about 120 g-cm.

22. The paper or paperboard substrate of claim 1 wherein the substrate has a Mullen Index from about 80 psi to about 130 psi.

23. The paper or paperboard substrate of claim 1 wherein the substrate has an internal bond from about 10 ft-lbs*$10^{-3}$/$in^2$ to about 120 ft-lbs*$10^{-3}$/$in^2$.

24. The paper or paperboard substrate of claim 1 wherein the substrate has a ring crush from about 40 lbs to about 120 lbs.

* * * * *